US007254965B2

(12) United States Patent
Ahn

(10) Patent No.: US 7,254,965 B2
(45) **Date of Patent: *Aug. 14, 2007**

(54) WASHING MACHINE

(75) Inventor: In Geun Ahn, Changwon shi (KR)

(73) Assignee: LG Electronics Inc., Seoul (KR)

( * ) Notice: Subject to any disclaimer, the term of this patent is extended or adjusted under 35 U.S.C. 154(b) by 475 days.

This patent is subject to a terminal disclaimer.

(21) Appl. No.: 10/257,257

(22) PCT Filed: Feb. 19, 2002

(86) PCT No.: PCT/KR02/00259

§ 371 (c)(1),
(2), (4) Date: Oct. 10, 2002

(87) PCT Pub. No.: WO02/066726

PCT Pub. Date: Aug. 29, 2002

(65) Prior Publication Data

US 2003/0056554 A1 Mar. 27, 2003

(30) Foreign Application Priority Data

Feb. 19, 2001 (KR) ..... 2001/8247
Jun. 12, 2001 (KR) ..... 2001/32863

(51) Int. Cl.
*D06F 37/30* (2006.01)
*D06F 33/00* (2006.01)

(52) U.S. Cl. ..... 68/12.24; 68/23.6; 68/133

(58) Field of Classification Search ..... 68/23.6, 68/23.7, 133, 12.24; 192/17 C, 17 D, 18 R, 192/18 B, 12 D, 69.8, 71, 79, 84.6

See application file for complete search history.

(56) References Cited

U.S. PATENT DOCUMENTS

| | | | |
|---|---|---|---|
| 2,331,897 | A | 10/1943 | Dyer |
| 2,462,657 | A | 2/1949 | McNairy |
| 2,656,702 | A | 10/1953 | Chapin |
| 2,969,665 | A | 1/1961 | Saverio |
| 5,150,589 | A | 9/1992 | Williams et al. |
| 5,208,931 | A | 5/1993 | Williams et al. |

(Continued)

FOREIGN PATENT DOCUMENTS

| | | | |
|---|---|---|---|
| CN | 1224784 | A | 8/1999 |

(Continued)

*Primary Examiner*—Joseph L. Perrin
(74) *Attorney, Agent, or Firm*—McKenna Long & Aldridge LLP

(57) ABSTRACT

A washing machine is disclosed, in which a rotary power of a driving unit is stably provided to a pulsator or a washing tub in a short time. The washing machine includes a motor having a stator (7*a*) and a rotor (7*b*); a spin shaft (5) of a hollow, an upper end of the spin shaft is fastetned to a washing tub (2); a washing shaft (4) of which an upper end is fastened to a pulsator (3) inside of the washing tub; sliders (31) and (35) moving up and down along an outer circumference surface of the spin shaft to selective transmit a rotary power of the rotor to the spin shaft; an actuator (6) for inducing the up and down movement of the slider; a power transmission means between the actuator and the slider for converting a power transmittance path of the actuator and transmitting to the slider; and an attenuating means between the actuator and the slider for delaying a power generated from the actuator and then transmitting to the slider.

17 Claims, 15 Drawing Sheets

U.S. PATENT DOCUMENTS

| | | | | |
|---|---|---|---|---|
| 5,586,455 | A | 12/1996 | Imai et al. | |
| 5,737,944 | A * | 4/1998 | Nishimura et al. | 68/23.7 |
| 5,778,703 | A * | 7/1998 | Imai et al. | 68/23.7 |
| 5,884,507 | A | 3/1999 | Lee et al. | |
| 5,887,458 | A * | 3/1999 | Bae | 68/23.7 |
| 6,049,930 | A * | 4/2000 | Hisano et al. | 68/23.7 |
| 6,060,851 | A | 5/2000 | Imai et al. | |
| 6,148,646 | A * | 11/2000 | Koshiga et al. | 68/23.7 |
| 6,176,108 | B1 * | 1/2001 | Bae et al. | 68/23.7 |
| 6,194,894 | B1 * | 2/2001 | Apel et al. | 324/207.25 |
| 6,202,451 | B1 * | 3/2001 | Park et al. | 68/23.7 |
| 6,257,027 | B1 | 7/2001 | Imai | |
| 6,318,133 | B1 * | 11/2001 | Koshiga et al. | 68/23.7 |
| 6,332,343 | B1 | 12/2001 | Koketsu et al. | |
| 6,354,115 | B1 | 3/2002 | Zahn | |
| 6,470,714 | B2 * | 10/2002 | Koshiga et al. | 68/23.7 |
| 6,546,762 | B2 * | 4/2003 | Koshiga et al. | 68/23.7 |
| 2002/0166349 | A1 * | 11/2002 | Lim et al. | 68/23.7 |
| 2003/0131636 | A1 * | 7/2003 | Lim et al. | 68/23.7 |

FOREIGN PATENT DOCUMENTS

| | | | |
|---|---|---|---|
| EP | 239261 | | 9/1987 |
| JP | 04-256796 | | 9/1992 |
| JP | 10113494 | | 5/1998 |
| JP | 11347289 | A | 12/1999 |
| JP | 2000-70588 | | 3/2000 |
| JP | 2000-124640 | | 4/2000 |
| JP | 2000-279692 | | 10/2000 |
| JP | 2001-17783 | | 1/2001 |
| JP | 2002-070588 | | 3/2002 |
| KR | P0143223 | B1 | 4/1998 |
| KR | 100182544 | | 12/1998 |
| KR | 1020020067950 | A | 8/2002 |

* cited by examiner

WASHING MACHINE

TECHNICAL FIELD

The present invention relates to a washing machine, and more particularly, to a full automatic washing machine, in which washing and rinsing are carried out by a slow pulsator, and spinning is carried out by a fast washing tub.

BACKGROUND ART

In general, the washing machine removes various contaminants stuck to clothes, beddings, and the like, by softening action of detergents, friction caused by water circulation formed by rotation of the pulsator, and impact to laundry applied by the pulsator. Of the washing machines, the full automatic washing machine senses amount and kinds of laundry by sensors, and sets a washing method automatically, determines a water level properly with reference to the amount and kinds of the laundry, and makes washing under the control of a microcomputer.

There are the following driving types in the foregoing full automatic washing machines. First, there is a type in which a rotating power of a driving motor is transmitted by using a power transmission belt or pulley, to a washing shaft, for rotating the pulsator, or to a spinning shaft, for rotating the washing tub. In the meantime, there is a type of washing machine in which the speed of the washing tub is varied by using a BLDC motor in the washing and spinning.

There is a type of washing machine introduced recently, in which the power transmission path is differed even if the BLDC motor is employed, for slow rotation of the pulsator in washing, and fast rotation both of the pulsator and the washing tub in spinning, as disclosed in JP H11-347289.

However, the type of washing machine disclosed in JP H11-347289 has unstable operation caused by operation of a gear meshing clutch mechanism made by a solenoid, and noise occurred at the time of engagement of gears in a driving body.

DISCLOSURE OF INVENTION

An object of the present invention, for solving the foregoing various problems, lies on providing a washing machine, in which stable switching and transmission of a rotation power can be made from a driving part to a pulsator or a washing tub within a short time period.

To achieve the foregoing object, the present invention provides a washing machine including a motor having a stator, and a rotor rotatable by a current induced from the stator, a hollow spinning shaft having an upper end coupled with a washing tub, a washing shaft rotatably and singly fitted in a hollow part of the spinning shaft, having an upper end coupled with a pulsator fitted in the washing tub, a connector assembly fitted between the rotor and the washing shaft for transmission of a rotating force from the rotor to the washing shaft, a slider fitted to be movable up and down directions along an outside surface of the spinning shaft for selective transmission of the rotating force from the rotor to the spinning shaft, an actuator for producing a power for causing up and down movement of the slider, power transmission means between the actuator and the slider for converting and transmission of the power from the actuator to the slider, and buffer means between the actuator and the slider for delaying the power from the actuator to the slider.

Thus, the washing machine of the present invention can make stable supply of a rotating power to the pulsator or the washing tub with in a short time by action of the power transmission means and the buffer means.

BRIEF DESCRIPTION OF DRAWINGS

The accompanying drawings, which are included to provide a further understanding of the invention, together with the description serve to explain the principles of the invention.

In the drawings.

BEST MODE FOR CARRYING OUT THE INVENTION

Reference will now be made in detail to the preferred embodiments of the present invention, examples of which are illustrated in the accompanying drawings. In describing the present invention, same parts will be given the same names and reference symbols, and iterative description of the parts will be omitted.

First Embodiment

A washing machine in accordance with a first preferred embodiment of the present invention will be described with reference to FIGS. 1–5B.

Figure 1:
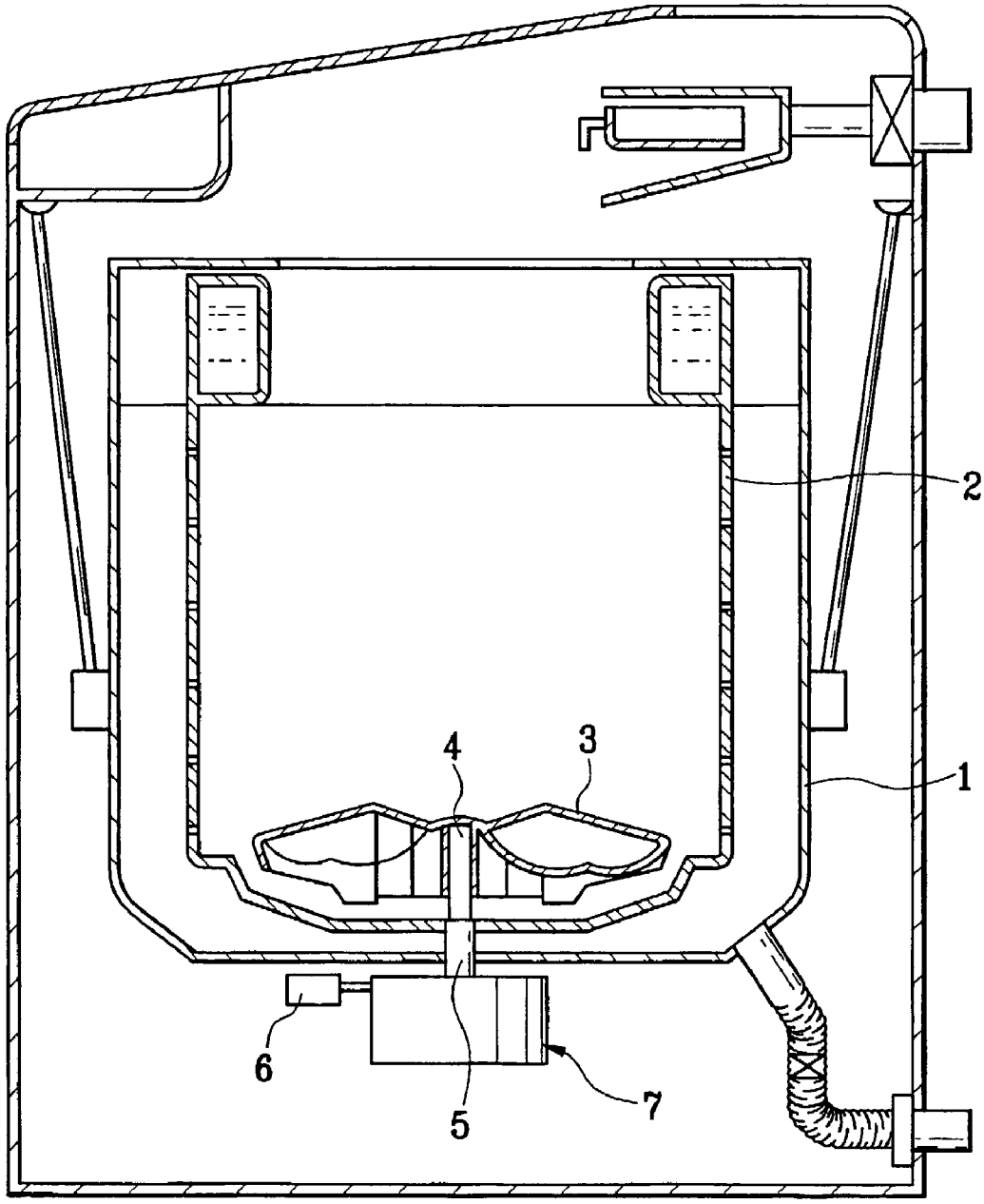
FIG. 1 illustrates a section showing a washing machine in accordance with a preferred embodiment of the present invention, schematically.

Referring to FIG. 1, the washing machine in accordance with a first preferred embodiment of the present invention includes a water storage tub 1 in a main body elastically supported from the main body, a washing tub 2 rotatably mounted in the water storage tub, a pulsator 3 rotatably fitted in the washing tub 2 independent from the washing tub 2, and a motor 7 fitted to an underside of the water storage tub 1 for rotating the washing tub 2 and the pulsator 3. There is a washing shaft 4 between the motor 7 and the pulsator 3 for transmission of a power from the motor 7 to the pulsator 3, and there is a spinning shaft 5 between the motor 7 and the washing tub 2 for transmission of power from the motor 7 to the washing tub 2.

The foregoing washing machine is required to supply the power from the motor 7 to the washing shaft 4 or the spinning shaft 5 selectively according to a washing cycle or a spinning cycle. To do this, there is a power switching device between the washing shaft 4 and spinning shaft 5 and the motor 7, for switching a power transmission path of the motor 7, to transmit the power of the motor 7 to the washing shaft 4 or to the spinning shaft 5, selectively.

The structure and operation of the washing machine and the power switching device in accordance with a first preferred embodiment of the present invention will be explained, in detail.

Figure 2:
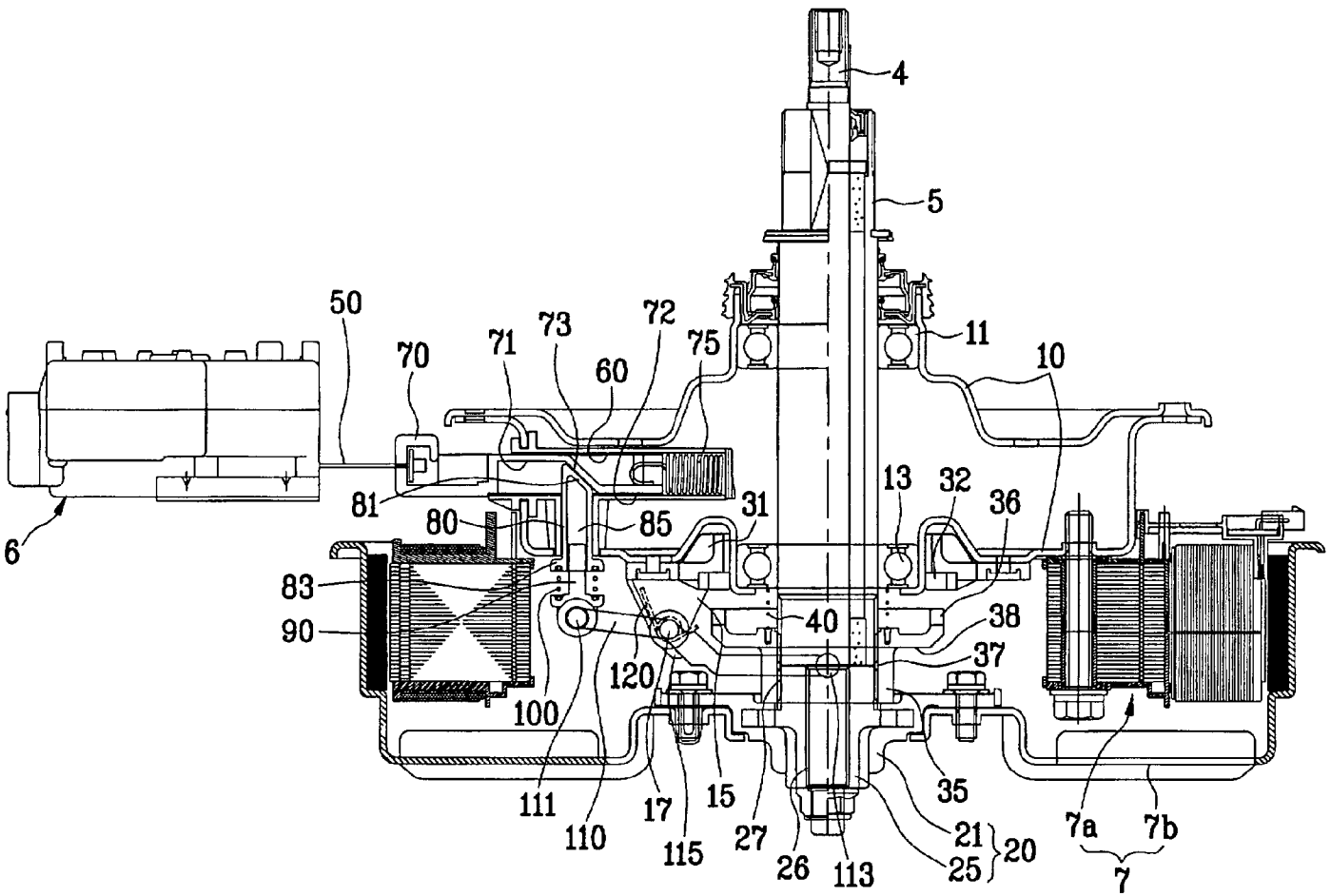
FIG. 2 illustrates a section showing a power switching device in a washing machine in accordance with a first preferred embodiment of the present invention.

Referring to FIG. 2, the washing machine in accordance with a first preferred embodiment of the present invention includes a motor 7 having a stator 7*a*, and a rotor 7*b* rotatable by a current induced thereto by the stator, a hollow spinning shaft 5 having a upper end coupled to the washing tub, and a washing shaft 4 rotatably and singly fitted in the hollow of the spinning shaft 4 having a upper end coupled with the pulsator. There is an oiless bearing between the washing shaft 4 and the spinning shaft 5, for rotatably supporting the washing shaft 4.

The spinning shaft 5 passes through the bearing housing 10 fitted under the washing tub. There are ball bearings 11, and 13 in an upper part and a lower part of the bearing housing 10, for rotatably supporting the spinning shaft 5.

There is a connector assembly 20 between the rotor 7*b* and the washing tub 4 for transmission of a rotating force of the rotor 7*b* to the washing shaft 4. A structure of the connector assembly 20 will be described in detail, later.

The power switching device includes one pair of sliders 31, and 35 movably fitted along an outside surface of the spinning shaft 5 for selective transmission of the rotating force from the rotor 7*b* to the spinning shaft 5, an actuator 6 for producing a power for causing up and down movement of the sliders, and power transmission means fitted between the actuator 6 and the sliders 31, and 35, for converting the power from the actuator 6 and transmitting to the sliders. There is a buffer means between the actuator 6 and the sliders 31, and 35 for delaying the power from the actuator to the sliders.

The actuator 6 is provided under the water storage tub, and causes left right horizontal movement of the power transmission means by electricity or a hydraulic power.

The sliders 31, and 35 are fixed under the bearing housing 10, inclusive of a stationary slider 31 having gear 32 fixed along an outer circumference, and a movable slider 35 coupled to the power transmission means to be movable in up and down direction, having a movable gear 36 fit to the gear 32 on an outside surface. The stationary slider 31 is supported on a bracket 15 fixed to the underside of the bearing housing 10.

The movable slider 35, a member moving up and down along an outer circumference of the spinning shaft 5, has serration 37 in an inside surface thereof to be selectively coupled with the spinning shaft 5 or the connector assembly 20.

There is a compression spring 40 between the movable slider 35 and the stationary slider 31 having a restoration force in a direction suppressing coupling of the movable slider and the stationary slider. That is, the compression spring 40 is fitted between a top surface of the movable slider 35 and the lower side bearing 13, to push down the movable slider 35 in a state the power is not applied to the actuator 6.

The power transmission means includes a horizontal movement link 70 for receiving a linear movement from the actuator 6 to make a linear movement in left and right direction, a vertical movement link 80 in contact with the horizontal movement link for moving in up and down directions when the horizontal movement link moves, and a rotational movement link 110 coupled with the vertical movement link for moving the movable slider 35 in up and down directions as the rotational movement link 110 rotates when the vertical movement link moves.

There is a connected rod 50 between the actuator 6 and the horizontal movement link 70, for pulling the horizontal movement member 70 when a power is provided to the actuator 6.

The horizontal movement link 70 makes a linear movement guided by a guide 60 fixed to the bearing housing 10. The horizontal movement link 70 has a special shape for causing the up and down movement of the vertical movement link 80. That is, a contact surface of the horizontal movement link 70 with the vertical movement link 80 includes an upper horizontal surface 71 for fixing a upper limiting point of the vertical movement link, a lower horizontal surface 72 for fixing a lower limiting point of the vertical movement link, and a sloped surface 73 between the upper horizontal surface 71 and the lower horizontal surface 72 for causing a continuous up and down movement of the vertical movement link 80.

There is a return spring 75 for assisting return of the horizontal movement link 70 when the actuator 6 is turned off. The return spring 75 has two ends connected to one ends of the horizontal movement link 70 and the guide 60, for making the horizontal movement link 70 to return to an original state when a pulling force of the actuator 6 on the horizontal movement link is removed.

An upper end 81 of the vertical movement link 80 in contact with the horizontal movement link 70 has a sloped surface in conformity with the sloped surface 73 of the horizontal movement link. Therefore, when the upper end 81 of the vertical movement link 81 is brought into contact with the upper horizontal surface 71 of the horizontal movement link, the vertical movement link 80 is at the upper limiting point, and when the upper end 81 of the vertical movement link 81 is brought into contact with the lower horizontal surface 72 of the horizontal movement link, the vertical movement link 80 is at the lower limiting point. The up and down movements of the vertical movement link 80 are continuous because the upper end 81 is in surface to surface contact with the sloped surface 73 of the horizontal movement link 70.

The rotational movement link 110 has one end 111 coupled to a lower end 83 of the vertical movement link indirectly, and the other end 113 in contact with the movable slider 35. A body of the rotational movement link 110 is rotatably coupled to a fixing pin 17 fixed to the bracket 15. Accordingly, the rotational movement link 110 rotates in a counter clockwise direction around the fixing pin 17 when the vertical movement link 80 moves down, making the movable slider 35 to move upward.

There is a torsion spring 120 for assisting return of the rotational movement link 110 when the actuator 6 is turned off. The torsion spring has a center inserted to an outside surface of the fixing pin 17, one end fixed to the bracket 15, and the other end coupled to the rotational movement link 110. Therefore, when the rotational movement link 110 rotates in a counter clockwise direction as the one end 111 of the rotational movement link moves down, the torsion spring 120 is twisted. If the force applied to the one end 111 of the rotational movement link is removed at turn off of the actuator 6, the torsion spring 120 rotates the rotational movement link 110 in a clockwise direction as the torsion spring 120 is restored to an original state.

In the meantime, for limiting a moving down position of the movable slider 35 when the actuator 6 is turned off, there is a stopper 115 fitted to one side of the bracket 15 for contact with the rotational movement link 110. When the rotational movement link 110 rotates in a clockwise direction, the stopper 115 comes into contact with the rotational movement link to limit a rotation angle of the rotational movement link 110, thereby limiting moving down of the movable slider 35.

On the other hand, when the movable slider 35 moves up, and engages with the stationary slider 31, there may be a case the movable gear 36 and the stationary gear 32 are miss engaged, i.e., top parts of gear teeth of the stationary gear 32 and the movable gear 36 abut, which is defined as a momentary seizure. If the rotational movement link 110 keeps to move up the movable slider 35 in this momentary seizure state, a normal coupling of the stationary gear 32 with the movable gear 36 become more difficult. To solve this problem, it is required to delay the power transmitted from the actuator 6 to the movable slider 35 momentarily, and one that carries out such a function is buffer means.

The buffer means is fitted between the vertical movement link 80 and the rotational movement link 110. The buffer means includes a plunger 90 movably fitted in a guide groove 85 having a lower end coupled to the rotational movement link 110 and an upper end formed inside of the vertical movement link 80, and a buffer spring 100 fitted between the lower end of the plunger 90 and the lower end 83 of the vertical movement link 80. Under a normal operation state, the buffer spring 100 transmits movement of the vertical movement link 80 to the rotational movement link 110 as it is, and, in the momentary seizure state, absorbs movement of the vertical movement link 80 temporarily, and transmits to the rotational movement link 110. To do this, it is required that an elastic modulus of the buffer spring 110 is greater than an elastic modulus of the torsion spring 120. Therefore, in a normal operation state, because the buffer spring 100 has an elastic modulus greater than the torsion spring 120, the buffer spring 100 receives downward movement of the vertical movement link 80, and transmits to the rotational movement link 110 without being deformed. In the momentary seizure state, the buffer spring 100 delays transmission of the downward movement of the vertical movement link 80 momentarily as the buffer spring 100 is compressed, and absorbs the downward movement.

In the meantime, the connector assembly 20 includes an outer connector 21 of a plastic coupled to the rotor 7*b*, and an inner connector 25 inside of the outer connector and coupled to the washing shaft 4. The inner connector 25 has a first serration 26 formed in an inside surface thereof coupled to a lower surface of the washing shaft 4, and a second serration 27 in an outside surface thereof exposed to outside of the outer connector 21 for coupling with the serration 37 in the movable slider 35. It is preferable that the inner connector is formed of sintered aluminum alloy for securing an adequate strength.

Figure 3A:
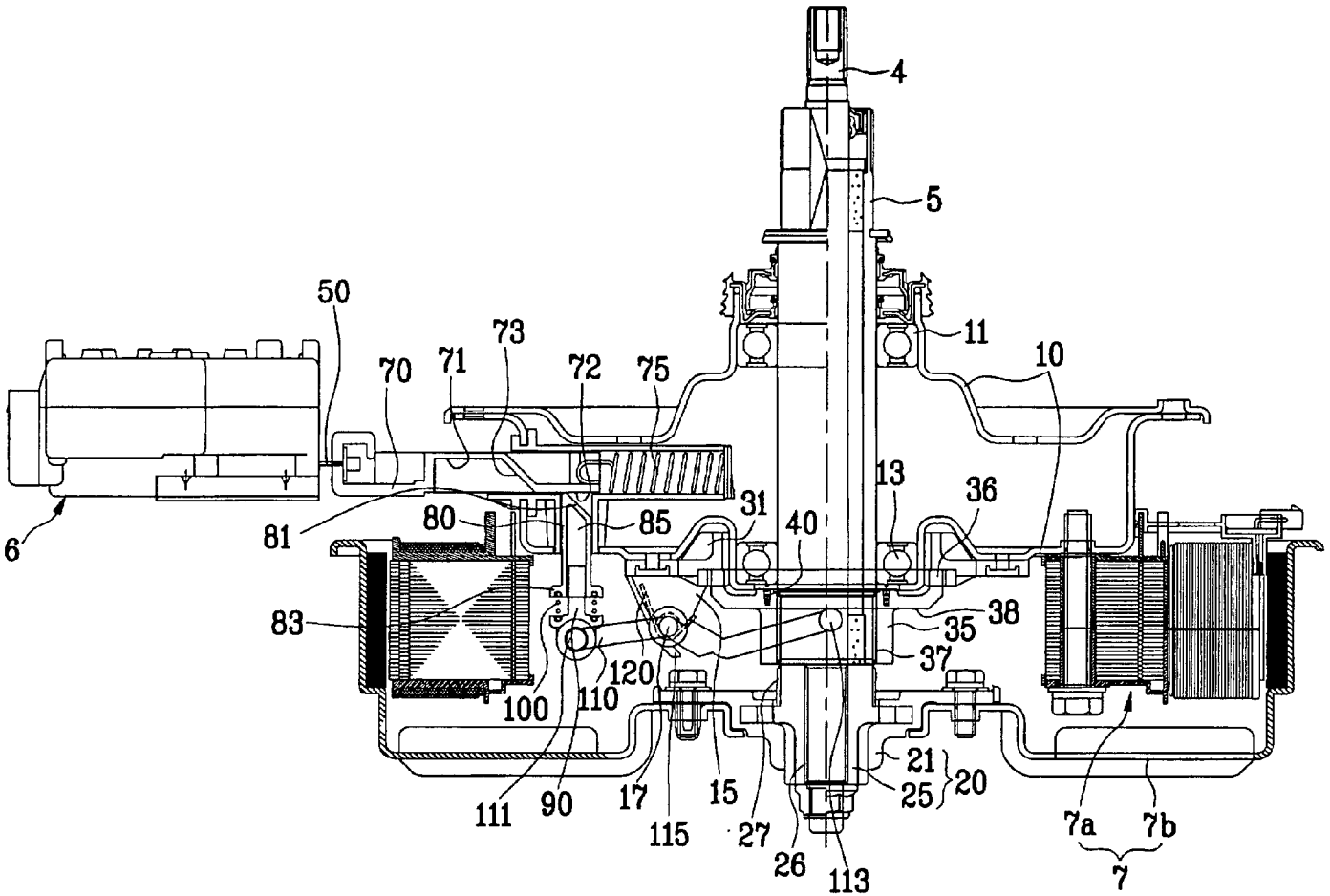
FIG. 3A illustrates a section showing operation of the power switching device in FIG. 2 in washing.
Figure 3B:
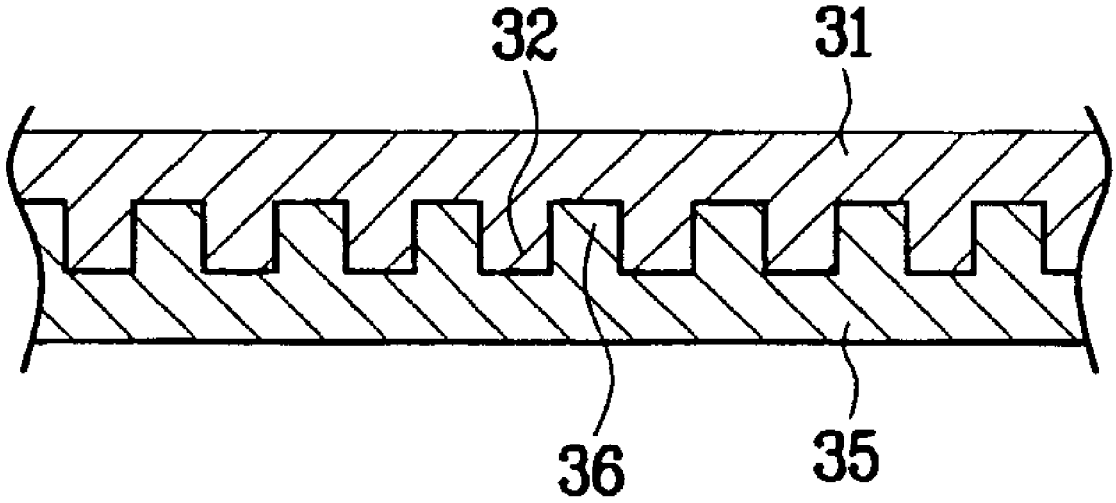
FIG. 3B illustrates a section showing an enlarged view of a slider in the power switching device in FIG. 3A.

The operation of the washing machine in accordance with a first preferred embodiment of the present invention will be explained. FIGS. 3A and 3B illustrate a washing cycle of the washing machine of the present invention.

Referring to FIG. 3A, upon application of power to the actuator 6, the connecting rod 50 pulls the horizontal movement link 70. In this instance, the horizontal movement link 70, guided by the guide 60, moves toward the actuator 6, and the return spring 75 is pulled.

On the same time with this, the upper end 81 of the vertical movement link 80 makes a relative movement down to the lower horizontal surface 72 along the sloped surface 73, such that the vertical movement link 80 rests on the lower limiting point. In this instance, the downward movement of the vertical movement link 80 is transmitted to the buffer spring 100, and the buffer spring 100 moves down one end 111 of the rotational movement link 110 without being deformed, under a reason explained before.

According to this, the rotational movement link 110 rotates around the fixing pin 17 in a counter clockwise direction, so that the movable slider 35 in contact with the other end 113 of the rotational movement link moves up along the spinning shaft 5. The upward movement of the movable slider 35 is continued until the movable gear 36 engages with the stationary gear 32 perfectly, which state is shown in FIG. 3B.

In this instance, the movable slider 35 is decoupled from the inner connector 25 completely. That is, the serration 37 in the movable slider 35 is only coupled to the outside surface of the spinning shaft 5, but separated from the second serration 27 in the inner connector.

In this state, the rotating force of the rotor 7*b* is transmitted to the washing shaft 4 only. Accordingly, since only the pulsator coupled with the washing shaft 4 is rotated, the washing cycle is carried out.

Figure 4A:
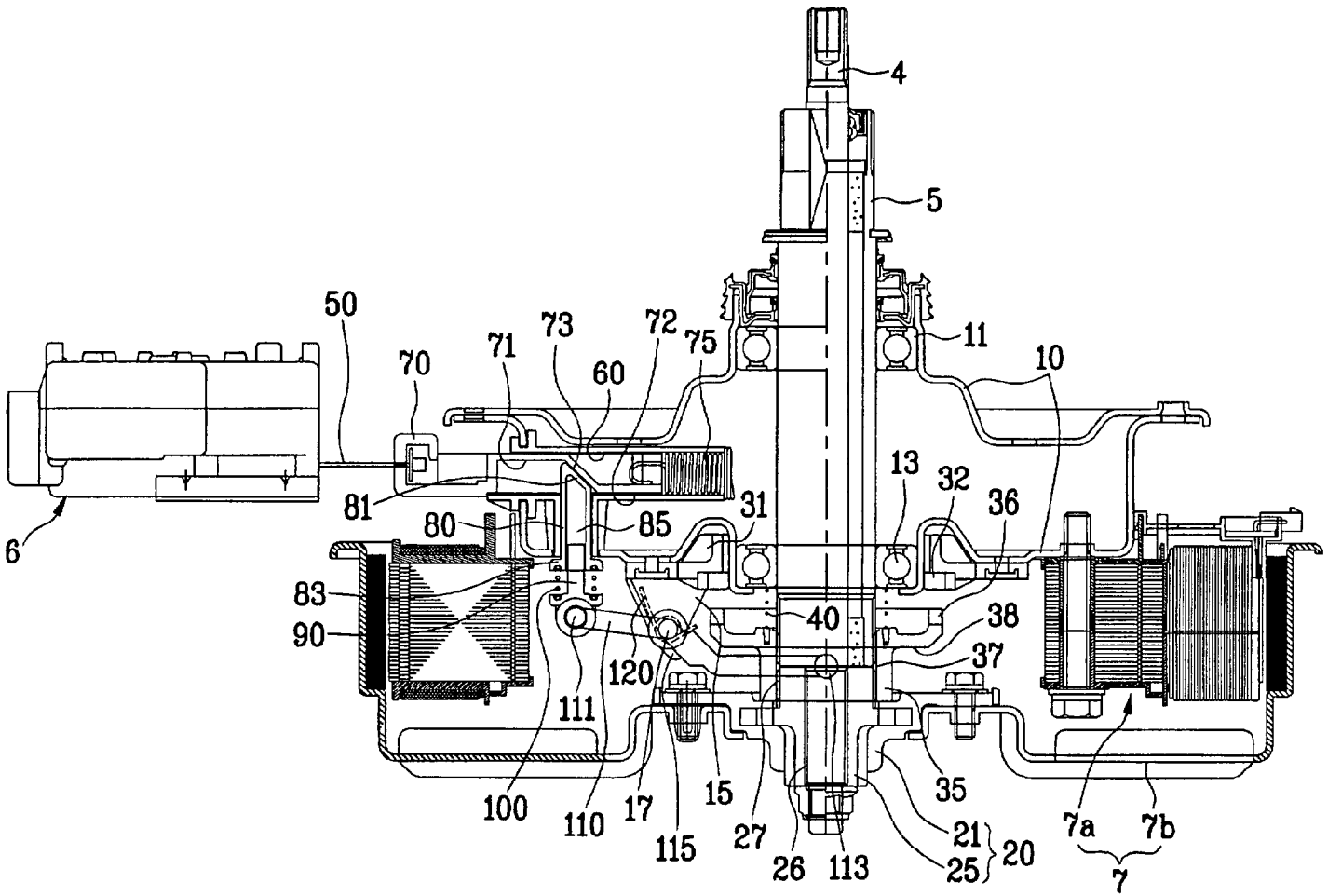
FIG. 4A illustrates a section showing operation of the power switching device in FIG. 2 in spinning.
Figure 4B:
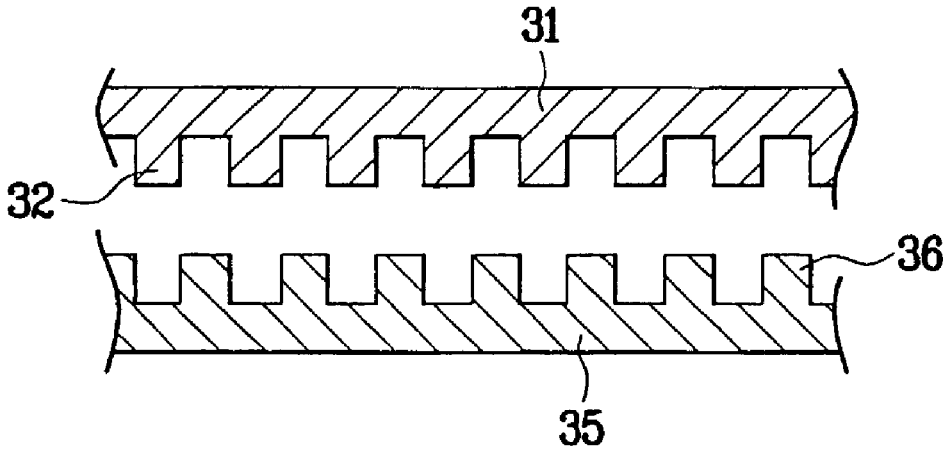
FIG. 4B illustrates a section showing an enlarged view of a slider in the power switching device in FIG. 4A.

Next, FIGS. 4A and 4B illustrate a spinning cycle of the washing machine of the present invention.

Referring to FIG. 4A, as the power to the actuator 6 is cut off, the horizontal movement link 70 moves away from the actuator 6 by the restoring force of the return spring 75.

As a result, the force pressing the vertical movement link 80 down is removed, leaving the vertical movement link 80 free to move upward. According to this, the force to the one end 111 of the rotational movement link 110 is also removed, permitting the rotational movement link 110 to turn around the fixing pin 17 in the clockwise direction by restoring force of the torsion spring 120. The rotational movement link 110 rotates to an angle the rotational movement link 110 comes into contact with the stopper 115. As a result, the vertical movement link 80 moves up together with the one end 111 of the rotational movement link, which moves up, until the upper end 81 of the vertical movement link comes into contact with the upper horizontal surface 71 of the horizontal movement link 70.

Then, the movable slider 35 moves down along the spinning shaft 5 by gravity and the restoring force of the compression spring 40 as a supporting force of the rotational movement link 110 is removed. The movable slider 35 moves down until the movable slider 35 comes into contact with the other end 113 of the rotational movement link 110. As a result, the stationary gear 32 and the movable gear 36 are disengaged completely as shown in FIG. 4.

In this instance, the movable slider 35 is coupled both to the spinning shaft 5 and the inner connector 25. That is, the serration of the movable slider is engaged both to the outside surface of the spinning shaft 5 and the second serration 27 of the inner connector.

In this state, the rotating force of the rotor 7*b* is transmitted, not only to the washing shaft 4, but also to the spinning shaft 5 through the movable slider 35. According to this, a spinning cycle is carried out as the pulsator coupled to the washing shaft 4 and the washing tub coupled to the spinning shaft 5 rotate.

Figure 5A:
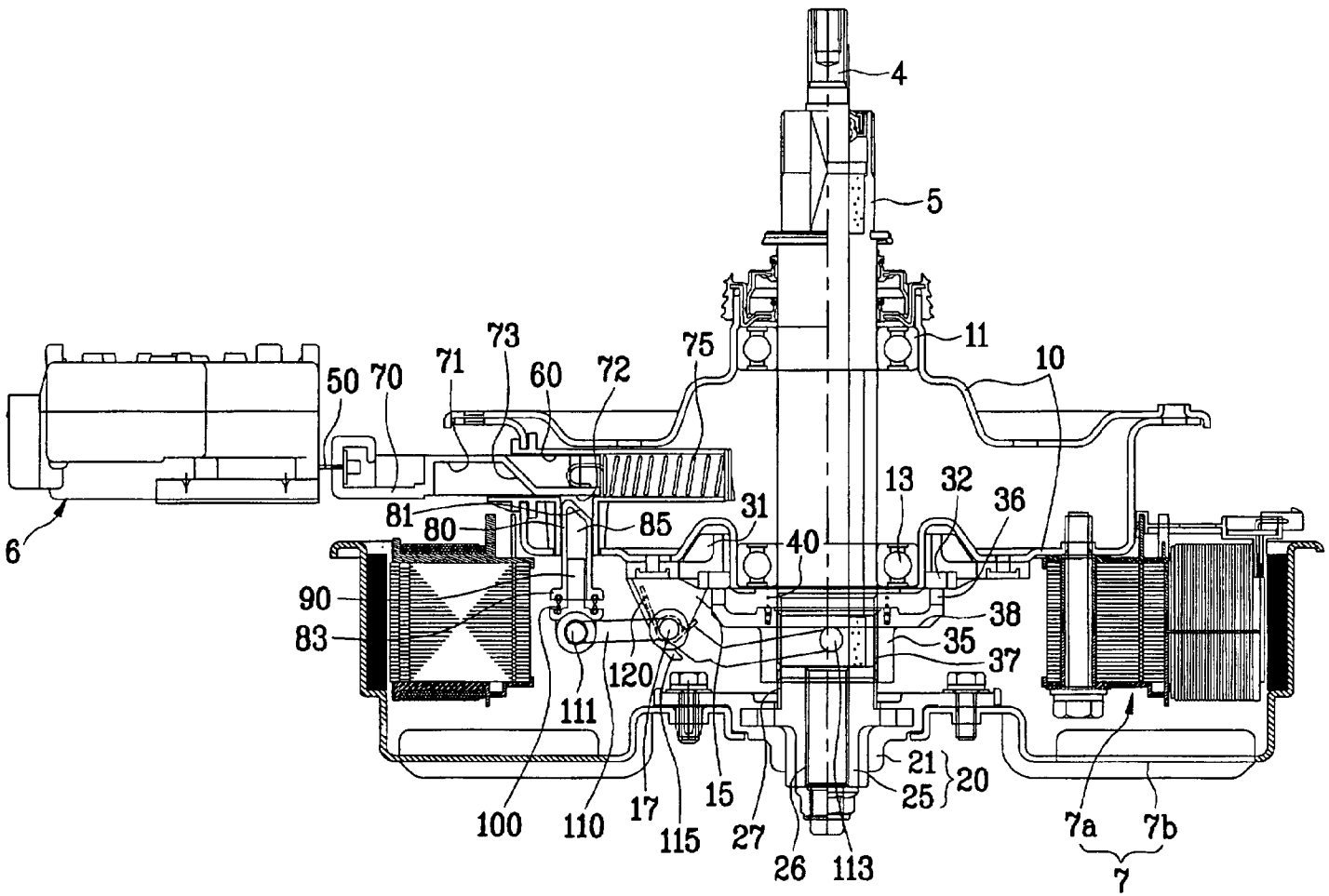
FIG. 5A illustrates a section showing operation of the power switching device in FIG. 2 in seizure.
Figure 5B:
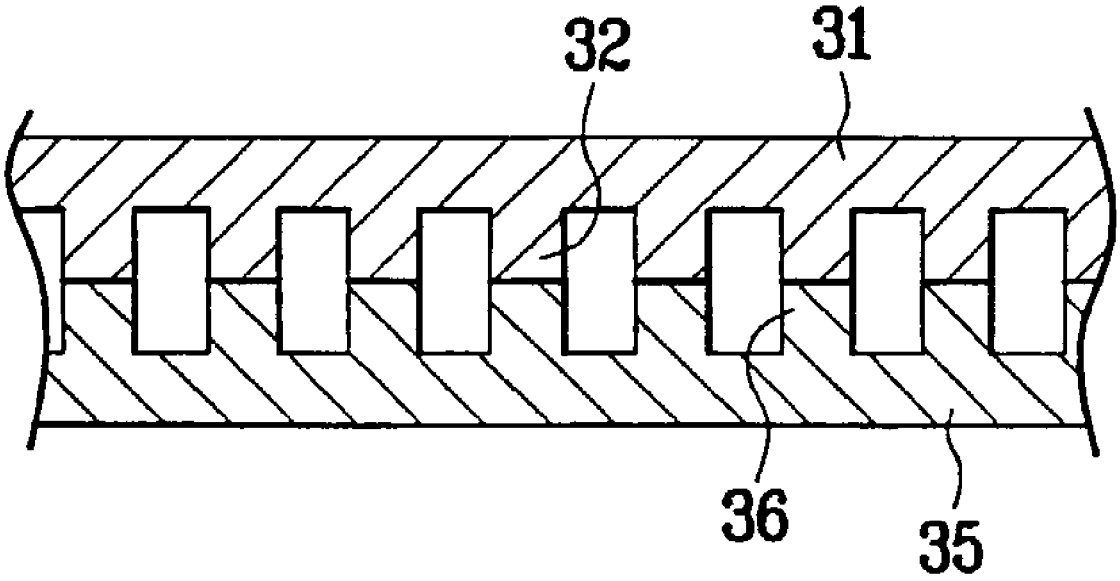
FIG. 5B illustrates a section showing an enlarged view of a slider in the power switching device in FIG. 5A.

Next, FIGS. 5A and 5B illustrate a spinning cycle of the washing machine of the present invention.

Referring to FIG. 5A, a power is provided to the actuator 6 for carrying out a washing cycle, and the movable slider 35 moves up supported by the rotational movement link 110 through a process as described before. In this instance, since the movable slider 35 is in a state the movable slider 35 is rotated with the spinning shaft 5, there may be a state the movable gear 36 and the stationary gear 32 are engaged, as shown in FIG. 5B.

In this instance, while the vertical movement link 80 keeps moving down, the rotational movement link 110 can move in a counter clockwise direction, no more. According to this, the downward movement of the vertical movement link 80 causes the plunger 90 to make a relative upward movement along the guide groove 85, and the buffer spring 100 compressed. As a result, the buffer spring 100 absorbs a force of the vertical movement link 80, such that a force of the rotational movement link 110, which tends to enforce the movable slider 35 to move upward, can be removed.

In this instance, the movable slider 35 is in a state the movable slider 35 is coupled with the inner connector 25. Therefore, the rotor 7*b* rotates together with the movable slider 35, and, when the movable slider 35 rotates, there is a moment the movable gear 36 and the stationary gear 32 are engaged normally, when the buffer spring 100 is restored to rotate the rotational movement link 110 in a counter clockwise direction, and, as a result, the movable slider 35 keeps moving up, to release the momentary seizure as the movable gear 36 and the stationary gear 32 are coupled, perfectly.

Second Embodiment

A washing machine in accordance with a second preferred embodiment of the present invention will be explained, with reference to FIGS. 6–9B.

Figure 6:
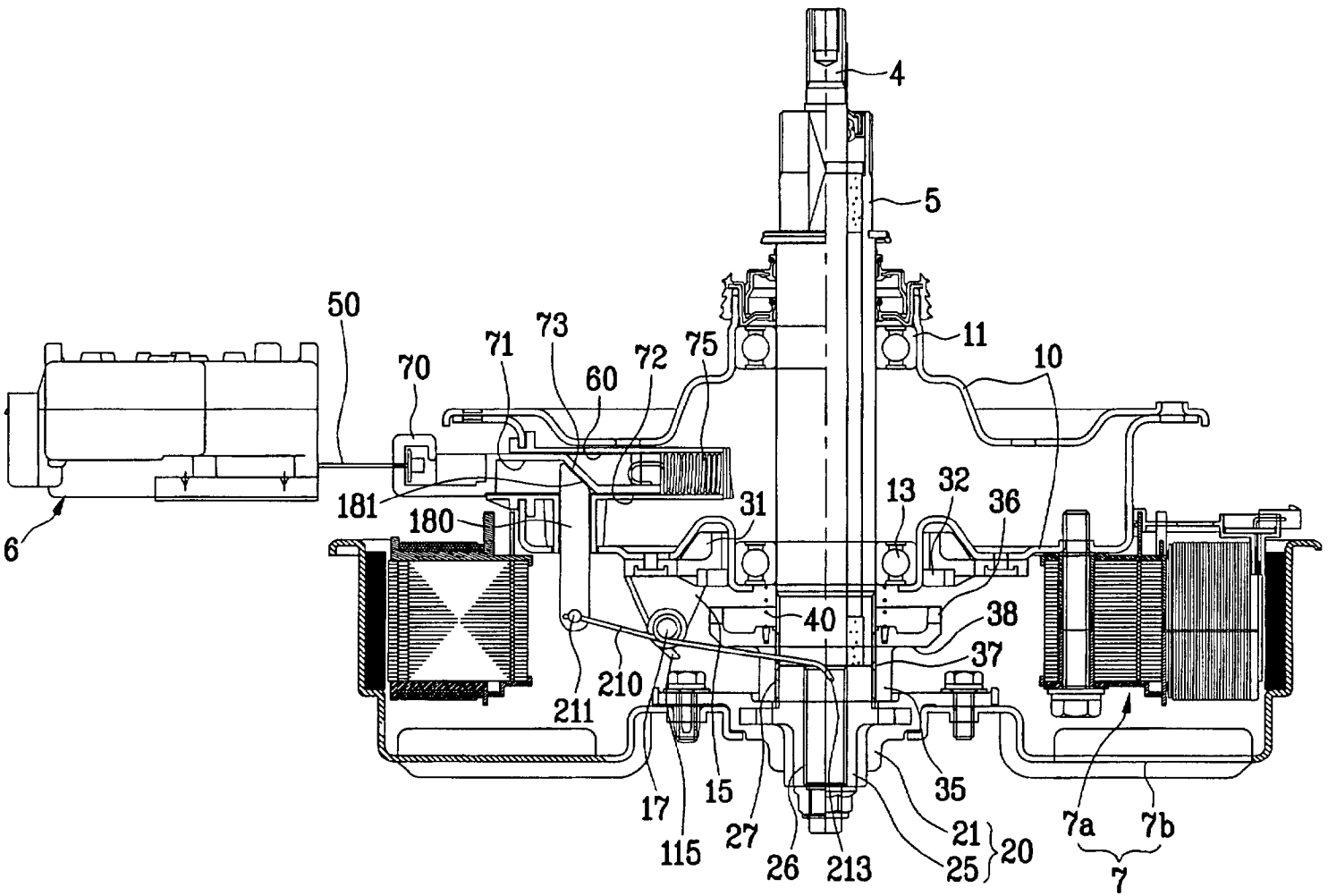
FIG. 6 illustrates a section showing a power switching device in a washing machine in accordance with a second preferred embodiment of the present invention.

Referring to FIG. 6, the washing machine in accordance with a second preferred embodiment of the present invention includes a motor 7 having a stator 7*a*, and a rotor 7*b* fitted rotatable by a current induced thereto from the stator, a hollow spinning shaft 5 having an upper end coupled to a washing tub, and a washing shaft 4 rotatably and singly fitted in the hollow of the spinning shaft having an upper end coupled to the pulsator. There is an oiless bearing between the washing shaft 4 and the spinning shaft 5, for rotatably supporting the washing shaft 4.

The spinning shaft 5 passes through the bearing housing 10 fitted under the washing tub. There are ball bearings 11, and 13 in an upper part and a lower part of the bearing housing 10, for rotatably supporting the spinning shaft 5.

There is a connector assembly 20 between the rotor 7*b* and the washing tub 4 for transmission of a rotating force from the rotor 7*b* to the washing shaft 4. A structure of the connector assembly 20 is identical to the same of the first embodiment, and iterative explanation thereof will be omitted.

The power switching device in accordance with a second preferred embodiment of the present invention includes one pair of sliders 31, and 35 movably fitted along an outside surface of the spinning shaft 5 for selective transmission of the rotating force from the rotor 7*b* to the spinning shaft 5, an actuator 6 for producing a power for causing up and down movement of the sliders, and power transmission means fitted between the actuator 6 and the sliders 31, and 35, for converting the power from the actuator 6 and transmitting to the sliders. There is a buffer means between the actuator 6 and the sliders 31, and 35 for delaying the power from the actuator to the sliders.

The actuator 6 and the sliders 31 and 35 are identical to the same in the first embodiment, and iterative explanation of the structure and operation will be omitted.

The power transmission means includes a horizontal movement link 70 for receiving a linear movement from the actuator 6 to make a linear movement in left and right directions, a vertical movement link 180 in contact with the horizontal movement link 70 for moving in up and down directions when the horizontal movement link moves, and a torsion spring 210 coupled with the vertical movement link 180 for receiving the movement of the vertical movement link, and moving the movable slider 35 in up and down directions.

There is a connected rod 50 between the actuator 6 and the horizontal movement link 70, for pulling the horizontal movement member 70 when a power is provided to the actuator 6.

The horizontal movement link 70 makes a linear movement guided by a guide 60 fixed to the bearing housing 10. The horizontal movement link 70 has a special shape for causing the up and down movement of the vertical movement link 180. That is, a contact surface of the horizontal movement link 70 with the vertical movement link 180 includes an upper horizontal surface 71 for fixing an upper limiting point of the vertical movement link 180, a lower horizontal surface 72 for fixing a lower limiting point of the vertical movement link 180, and a sloped surface 73 between the upper horizontal surface 71 and the lower horizontal surface 72 for causing a continuous up and down movement of the vertical movement link 180.

There is a return spring 75 between the horizontal movement link 70 and the guide 60 for assisting return of the horizontal movement link 70 when the actuator 6 is turned off.

An upper end 181 of the vertical movement link 80 in contact with the horizontal movement link 70 has a sloped surface in conformity with the sloped surface 73 of the horizontal movement link. Therefore, when the upper end 181 of the vertical movement link is brought into contact with the upper horizontal surface 71 of the horizontal movement link, the vertical movement link 180 is at the upper limiting point, and when the upper end 181 of the vertical movement link 180 is brought into contact with the lower horizontal surface 72 of the horizontal movement link, the vertical movement link 180 is at the lower limiting point. The up and down movements of the vertical movement link 180 are continuous because the upper end 181 is in surface to surface contact with the sloped surface 73 of the horizontal movement link.

The torsion spring 210 has one end 211 fastened to a lower end of the vertical movement link 180, and the other end 213 in contact with the movable slider 35, and a center part rotatably fitted to the fixing pin 17 fixed to one side of the bracket 15.

The torsion spring 210 serves both as the power transmission means and the buffer means. That is, under a normal operation state, the torsion spring 210 rotates around the fixing pin 17 in a counter clockwise direction, and moves the movable slider 35 up when the vertical movement link 180 moves down. Under the momentary seizure state, since movement of the other end 213 of the torsion spring is limited by the movable slider 35, the torsion spring 210 absorbs the downward movement of the vertical movement link 180 temporarily as the torsion spring itself is twisted.

For this, it is required that the torsion spring 210 has an enough elastic modulus not to be twisted under the normal operation state.

In the meantime, for limiting a moving down position of the movable slider 35 when the actuator 6 is turned off, there is a stopper 115 fitted to one side of the bracket 15 for contact with the torsion spring 210. When the stopper 115 comes into contact with the torsion spring 210, the stopper 115 limits a rotation angle of the torsion spring 210, and as a result of this, the movable slider 35 can move down, no more due to the torsion spring.

Figure 7A:
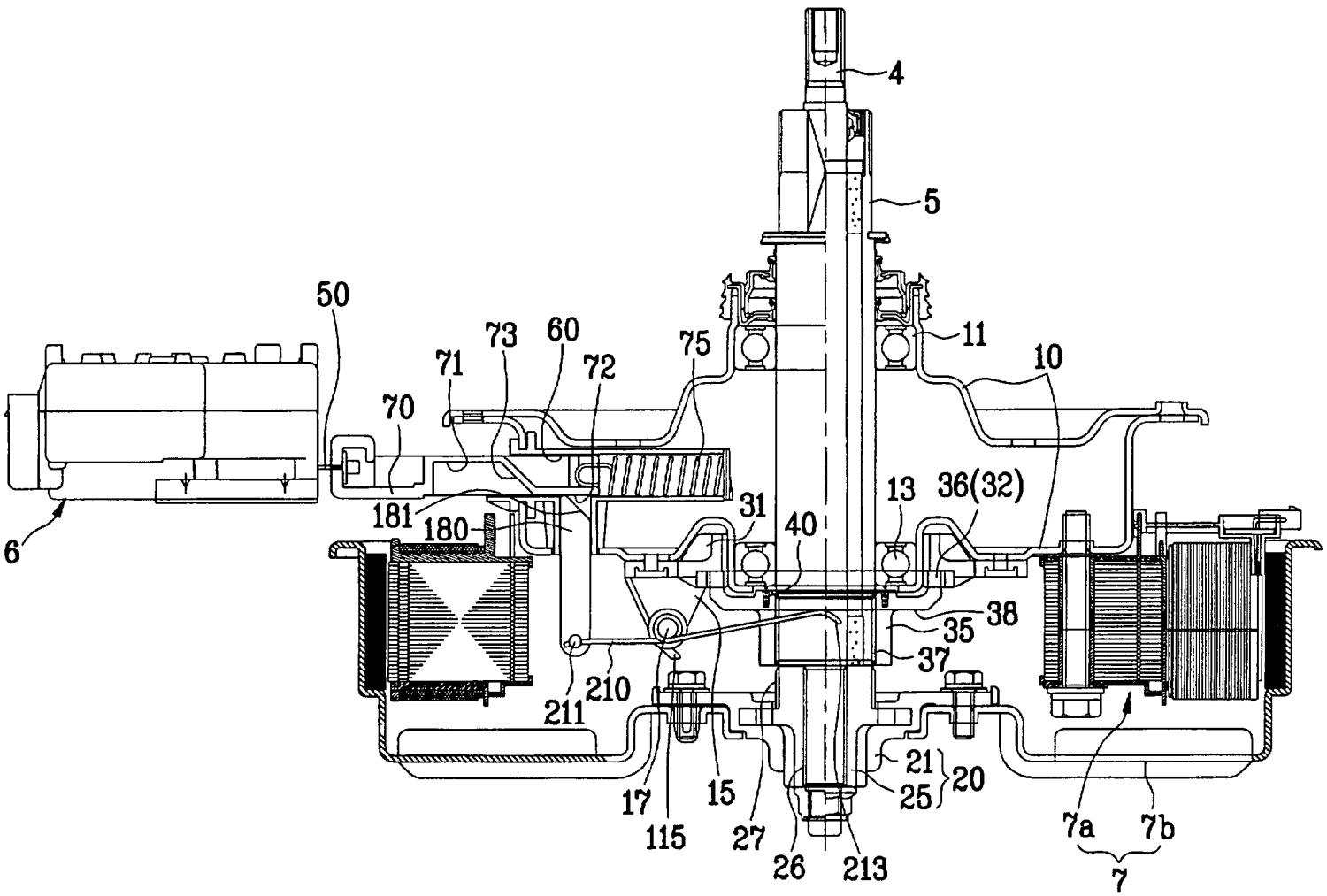
FIG. 7A illustrates a section showing operation of the power switching device in FIG. 6 in washing.
Figure 7B:
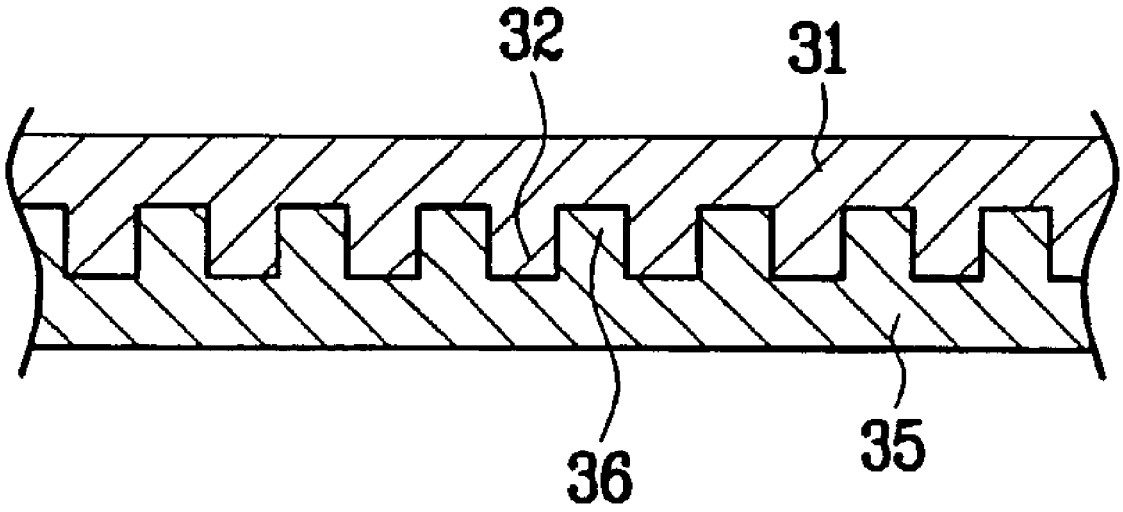
FIG. 7B illustrates a section showing an enlarged view of a slider in the power switching device in FIG. 7A.

The operation of the washing machine in accordance with a second preferred embodiment of the present invention will be explained. FIGS. 7A and 7B illustrate a washing cycle of the washing machine of the present invention.

Referring to FIG. 7A, upon application of power to the actuator 6, the connecting rod 50 pulls the horizontal movement link 70. In this instance, the horizontal movement link 70, guided by the guide 60, moves toward the actuator 6, and the return spring 75 is pulled.

On the same time with this, the upper end 81 of the vertical movement link 180 makes a relative movement down to the lower horizontal surface 72 along the sloped surface 73, until the vertical movement link 180 rests on the lower limiting point. In this instance, the downward movement of the vertical movement link 180 makes the one end 211 of the torsion spring 210 moves down, too.

According to this, the torsion spring 210 rotates around the fixing pin 17 in a counter clockwise direction, so that the movable slider 35 in contact with the other end 213 of the torsion spring moves up along the spinning shaft 5. The upward movement of the movable slider 35 is continued until the movable gear 36 engages with the stationary gear 32 perfectly, as shown in FIG. 7B.

In this instance, the movable slider 35 is in a state the movable slider 35 is completely decoupled from the inner connector 25. That is, the serration 37 in the movable slider 35 is only coupled to the outside surface of the spinning shaft 5, but separated from the second serration 27 in the inner connector.

In this state, the rotating force of the rotor 7*b* is transmitted to the washing shaft 4 only. Accordingly, since only the pulsator coupled with the washing shaft 4 is rotated, the washing cycle is carried out.

Figure 8A:
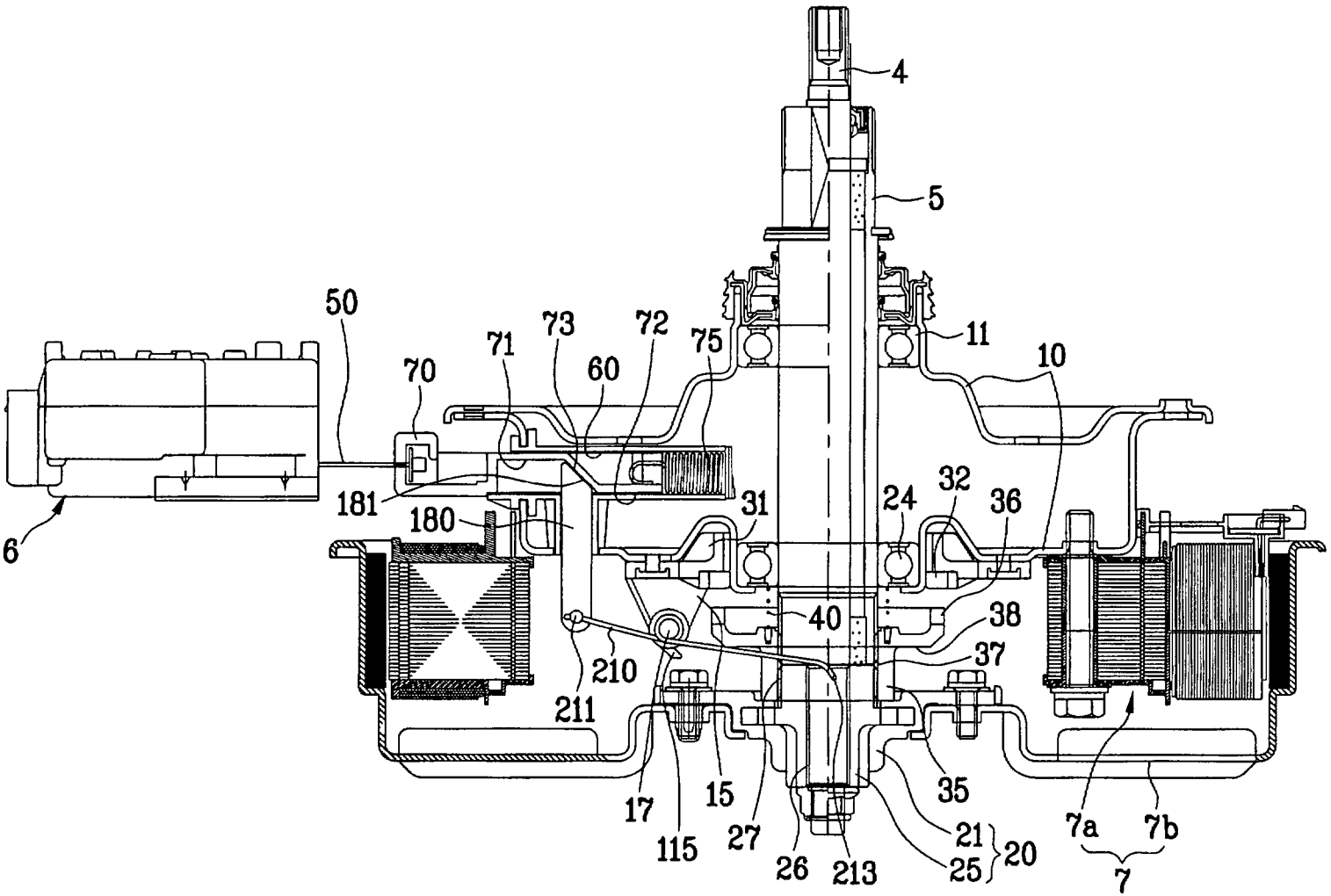
FIG. 8A illustrates a section showing operation of the power switching device in FIG. 6 in spinning.
Figure 8B:
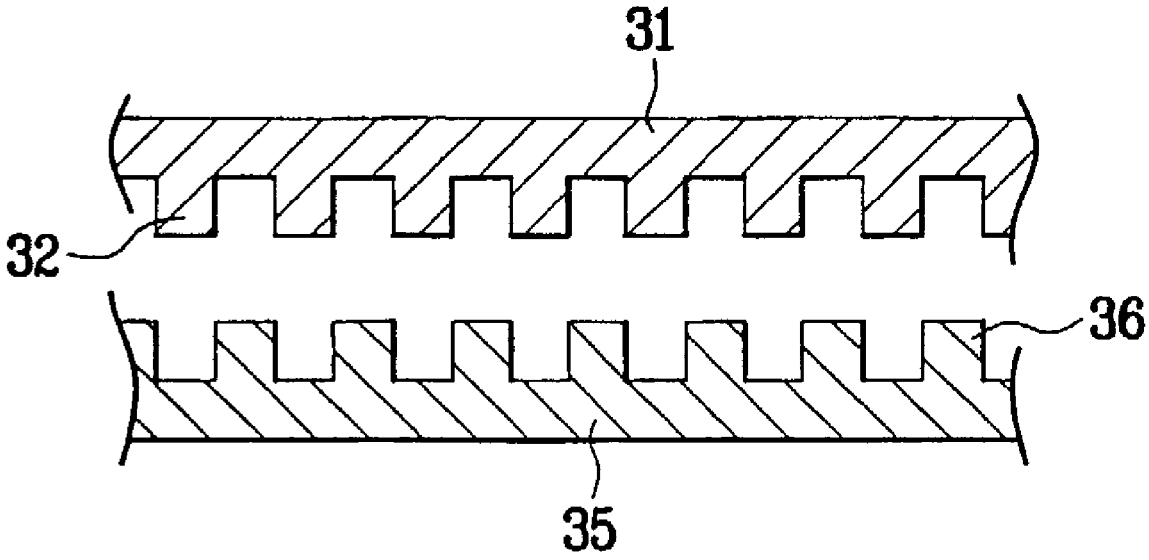
FIG. 8B illustrates a section showing an enlarged view of a slider in the power switching device in FIG. 8A.

Next, FIGS. 8A and 8B illustrate a spinning cycle of the washing machine of the present invention.

Referring to FIG. 8A, as the power to the actuator 6 is cut off, the horizontal movement link 70 moves away from the actuator 6 by the restoring force of the return spring 75.

As a result, the force pressing the vertical movement link 80 down is removed, leaving the vertical movement link 80 free to move upward. According to this, the force to the one end 211 of the torsion spring 40 is also removed, removing the force of the torsion spring supporting the movable slider 35, too.

In this instance, the movable slider 35 moves down along the spinning shaft 5 by gravity and the restoring force of the compression spring 40. According to this, the torsion spring turns around the fixing pin 17 in the clockwise direction until the torsion spring 210 comes into contact with the stopper 115. As a result, the vertical movement link 180 moves up until the upper end 181 of the vertical movement link 180 comes into contact with the upper horizontal surface 71 of the horizontal movement link 70.

As a result, the stationary gear 32 and the movable gear 36 are disengaged completely as shown in FIG. 8B. In this instance, the movable slider 35 is coupled both to the spinning shaft 5 and the inner connector 25. That is, the serration 37 of the movable slider 35 is engaged both to the outside surface of the spinning shaft 5 and the second serration 27 of the inner connector.

In this state, the rotating force of the rotor 7*b* is transmitted, not only to the washing shaft 4, but also to the spinning shaft 5 through the movable slider 35. According to this, a spinning cycle is carried out as the pulsator coupled to the washing shaft 4 and the washing tub coupled to the spinning shaft 5 rotate.

Figure 9A:
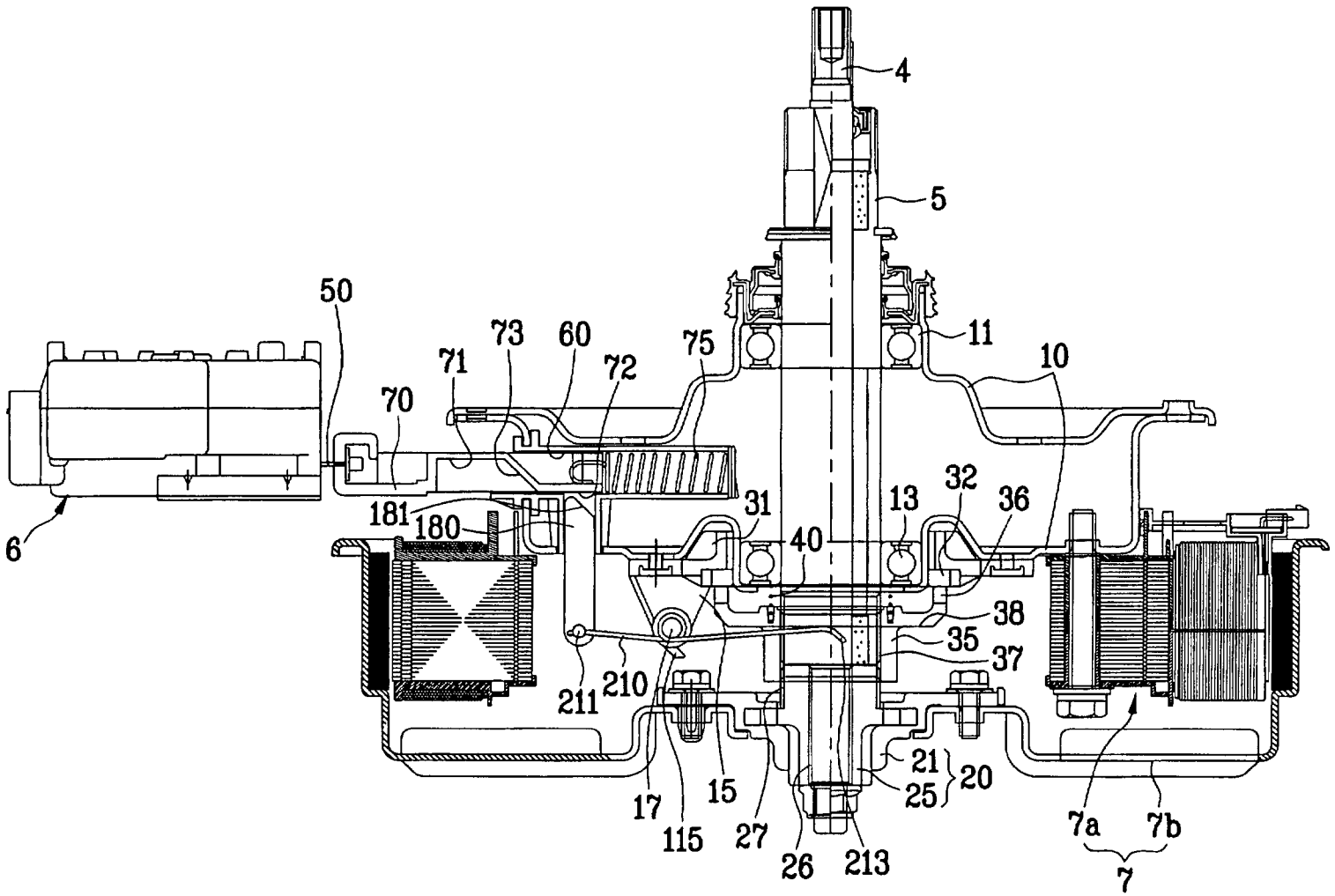
FIG. 9A illustrates a section showing operation of the power switching device in FIG. 6 in seizure.
Figure 9B:
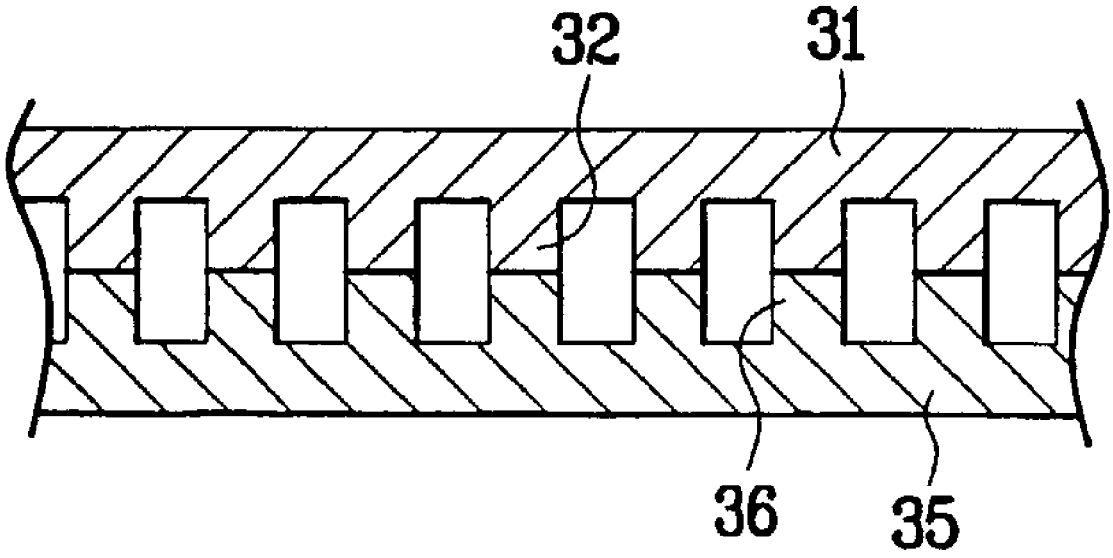
FIG. 9B illustrates a section showing an enlarged view of a slider in the power switching device in FIG. 9A.

Next, FIGS. 9A and 9B illustrate states of seizure of the washing machine of the present invention.

Referring to FIG. 9A, a power is provided to the actuator 6 for carrying out a washing cycle, and the movable slider 35 moves up supported by the torsion spring 210 through a process as described before. In this instance, since the movable slider 35 is in a state the movable slider 35 is rotated with the spinning shaft 5, there may be a state the movable gear 36 and the stationary gear 32 are engaged, as shown in FIG. 9B.

In this instance, while the vertical movement link 180 keeps moving down, the torsion spring can move in a counter clockwise direction, no more. According to this, the torsion spring 210 absorbs the downward movement of the vertical movement link 180 temporarily as the torsion spring 210 itself is twisted, such that a force of the torsion spring 210, which tends to enforce the movable slider 35 to move upward, is removed.

In this instance, the movable slider 35 is in a state the movable slider 35 is coupled with the inner connector 25. Therefore, the rotor 7*b* rotates together with the movable slider 35, and, when the movable slider 35 rotates, there is a moment the movable gear 36 and the stationary gear 32 are engaged normally, when the torsion spring 210 is restored to move the movable slider 35 upward, to release the momentary seizure as the movable gear 36 and the stationary gear 32 are coupled, perfectly.

In the meantime, instead of a type in which the serration is formed in a lower end part of the washing shaft 4, and the inner connector 25 is coupled with the serration, a type may be applied in which the lower end part of the washing shaft 4 is formed to be square, and the inner connector 25 is formed to be a hollow square ring to be coupled with the square shaft.

It will be apparent to those skilled in the art that various modifications and variations can be made in the washing machine of the present invention without departing from the spirit or scope of the invention. Thus, it is intended that the present invention cover the modifications and variations of this invention provided they come within the scope of the appended claims and their equivalents.

INDUSTRIAL APPLICABILITY

As has been explained, the washing machine of the present invention can switch driving power of a motor between a washing shaft and a spinning shaft within a short time through power transmission means. Moreover, the washing machine of the present invention can make a stable supply of the driving power of the motor to the washing shaft or the spinning shaft through the buffer means.

What is claimed is:

1. A washing machine comprising:

a motor having a stator, and a rotor rotatable by a current induced from the stator;

a hollow spinning shaft having an upper end coupled with a washing tub;

a washing shaft rotatably fitted in a hollow part of the spinning shaft, having an upper end coupled with a pulsator fitted in the washing tub;

a connector assembly fitted between the rotor and the washing shaft for transmission of a rotating force from the rotor to the washing shaft;

a slider fitted to be movable in up and down directions along an outside surface of the spinning shaft for selective transmission of the rotating force from the rotor to the spinning shaft;

an actuator for causing the up and down movement of the slider;

a rotational movement link;

a vertical movement member coupled with the rotational movement link, wherein the rotational movement link and the vertical movement member are disposed between the actuator and the slider for converting and transmitting power from the actuator to the slider; and a means between the actuator and the slider for absorbing power transmitted from the actuator to the slider, wherein the means includes a spring.

2. A washing machine as claimed in claim 1, wherein the slider includes:

a stationary slider fixed to a lower part of a bearing housing fitted under the washing tub, having a stationary gear formed along an outside circumference thereof; and a movable slider coupled to the rotational movement link to be movable in the upward and downward directions, having a serration in an inside surface for selective coupling with the spinning shaft or the connector assembly, and a movable gear on an outside surface fit to the stationary gear.

3. A washing machine as claimed in claim 2, wherein the connector assembly includes:

an outer connector connected to the rotor; and an inner connector inside of the outer connector having a first serration on an inner surface of the inner connector for coupling with a lower surface of the washing shaft, and having a second serration on an outside surface of the inner connector for coupling with the serration on the movable slider.

4. A washing machine as claimed in claim 3, wherein the inner connector has an aluminum sintered body.

5. A washing machine as claimed in claim 2, further comprising:

a horizontal movement link for receiving a linear force from the actuator through the connecting rod, and making a linear movement guided by a guide fixed to a bearing housing, wherein the vertical movement member has an upper end in contact with the horizontal movement link, movable in up and down directions along a shape of the horizontal movement link; and the rotational movement link has one end coupled to a lower end of the vertical movement member, the other end in contact with the movable slider, and a body between the one end and the other end rotatably fixed to a fixing pin at one side of the bearing housing, for rotating around the fixing pin when the vertical movement member moves up and down.

6. A washing machine as claimed in claim 5, wherein a contact surface of the horizontal movement link which contacts the vertical movement member includes:

an upper horizontal surface, and a lower horizontal surface for fixing an upper limiting point and a lower limiting point of the vertical movement member, respectively; and a sloped surface between the upper horizontal surface and the lower horizontal surface for causing continuous up and down movement of the vertical movement member.

7. A washing machine as claimed in claim 5, further comprising a return spring having one end connected to the horizontal movement link and the other end connected to the guide, the return spring assisting in the return of the horizontal movement link when the actuator is turned off.

8. A washing machine as claimed in claim 5, further comprising a torsion spring coupled with an outside surface of the fixing pin, having one fixed end, and the other end connected to the rotational movement link, said torsion spring assisting in the return of the rotational movement link when the actuator is turned off.

9. A washing machine as claimed in claim 5, further comprising a stopper fitted so as to come into contact with the rotational movement link, said stopper limiting a rotation angle of the rotational movement link, thereby limiting movement of the movable slider when the actuator is turned off.

10. A washing machine as claimed in claim 5, wherein the means includes:

a plunger having one end coupled to the rotational movement link, and the other end moving up and down along a guide groove inside of the vertical movement member, wherein the spring is fitted between one end of the plunger and a lower end of the vertical movement member, for transmission of movement of the vertical movement member to the rotational movement link, and absorbing the movement of the vertical movement member as the spring itself is compressed when the stationary gear and the movable gear are miss engaged.

11. A washing machine as claimed in claim 1, further comprising a compression spring between the movable slider and the stationary slider having a restoring force in a direction coupling of the movable slider and the stationary slider is suppressed.

12. A washing machine as claimed in claim 1, wherein the slider includes:

a stationary slider at a lower part of a bearing housing disposed under the washing tub, the stationary slider having a stationary gear formed along an outside circumference thereof; and a movable slider coupled to the spring, the movable slider being movable in the up and down directions, the movable slider having a serration in an inside surface which couples with the spinning shaft or the connector assembly, and a movable gear on an outside surface fit to the stationary gear.

13. A washing machine as claimed in claim 12, further comprising:

a horizontal movement link for receiving a linear force from the actuator through a connecting rod, the horizontal link guided by a guide fixed to a bearing housing wherein the vertical movement member is in contact with the horizontal movement link for moving up and down along the horizontal movement link, wherein the spring is a torsion spring fitted to a fixing pin at one side of the bearing housing such that one end thereof is fastened to a lower end of the vertical movement member and the other end thereof is in contact with the movable slider for transmission of up and down movement of the vertical movement member to the movable slider, where the torsion spring absorbs motion of the vertical movement member in a miss engagement of the stationary gear and the movable gear as the torsion spring itself is twisted.

14. A washing machine as claimed in claim 13, further comprising a stopper fitted so as to come into contact with the torsion spring, said stopper limiting the range of twisting of the torsion spring, thereby limiting the movement of the movable slider when the actuator is turned off.

15. A washing machine as claimed in claim 13, wherein a contact surface of the horizontal movement link which contacts the vertical movement member includes:

an upper horizontal surface and a lower horizontal surface for fixing an upper limiting point and a lower limiting point of the vertical movement member, respectively; and a sloped surface between the upper horizontal surface and the lower horizontal surface for causing continuous up and down movement of the vertical movement member link.

16. A washing machine as claimed in claim 13, further comprising a return spring having one end connected to the horizontal movement link, and the other end connected to the guide for assisting in the return of the horizontal movement link when the actuator is turned off.

17. A washing machine comprising:

a motor having a stator and a rotor rotatable by a current induced from the stator;

a hollow spinning shaft having an upper end coupled with a washing tub;

a washing shaft rotatably disposed in a hollow part of the hollow spinning shaft, the washing shaft having an upper end coupled with a pulsator in the washing tub;

a connector assembly between the rotor and the washing shaft, the connector assembly transmitting a rotating force from the rotor to the washing shaft;

a slider movable in up and down directions along an outside surface of the spinning shaft, the slider transmitting the rotating force from the rotor to the spinning shaft;

an actuator which moves the slider;

a rotational movement link;

a vertical movement member coupled with the rotational movement link, wherein the rotational movement link and the vertical movement member are disposed between the actuator and the slider for converting and transmitting power from the actuator to the slider; and a spring between the actuator and the slider for absorbing power transmitted from the actuator to the slider.

* * * * *